United States Patent [19]

Hara

[11] Patent Number: 4,602,489

[45] Date of Patent: Jul. 29, 1986

[54] AUTOMATIC ICE MAKING MACHINE

[75] Inventor: Yasuo Hara, Shimane, Japan

[73] Assignee: Hoshizaki Electric Co., Ltd., Toyoaki, Japan

[21] Appl. No.: 683,201

[22] Filed: Dec. 18, 1984

[51] Int. Cl.[4] ..... F25C 5/10

[52] U.S. Cl. ..... 62/320; 62/347

[58] Field of Search ..... 62/320, 347

[56] References Cited

U.S. PATENT DOCUMENTS

| | | | |
|---|---|---|---|
| 2,806,357 | 9/1957 | Pichler | 62/320 X |
| 3,164,972 | 1/1965 | Swanson | 62/320 |
| 3,254,501 | 6/1966 | Brysselhout | 62/138 |
| 3,423,949 | 1/1969 | Leeson et al. | 62/320 X |
| 3,470,709 | 10/1969 | Asakawa | 62/347 |
| 3,918,267 | 11/1975 | Canter | 62/320 X |
| 4,357,807 | 11/1982 | Aleksandrow | 62/320 X |

FOREIGN PATENT DOCUMENTS

| | | |
|---|---|---|
| UM 43-42 | 1/1968 | Japan . |
| UMO 46-26931 | 9/1971 | Japan . |

*Primary Examiner*—William E. Tapolcai

*Attorney, Agent, or Firm*—Wenderoth, Lind & Ponack

[57] ABSTRACT

An automatic ice making machine or apparatus of the type in which ice-making water is directed in jets upwards towards a freezing grid or chamber having a large number of freezing cells. The apparatus has an ice-cutting frame having second partitioning plates at a preset spacing from and in opposition to the lower ends of the first partitioning plates of said freezing cells, and a heating means provided to the cutting frame. The second partitioning plates are heated by a hot gas pipe for melting and cutting the ice formed in the freezing cells the end of the ice formation state and the end of harvesting state being detected by a temperature sensor provided on the ice cutting frame.

15 Claims, 40 Drawing Figures

FIG. 1 (A) (PRIOR ART)
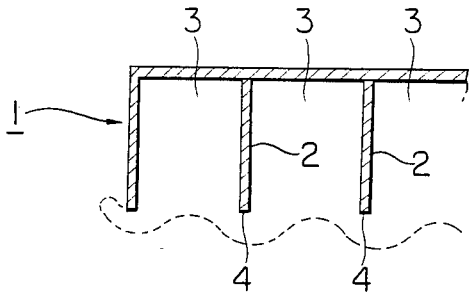
FIG. 1 (B) (PRIOR ART)
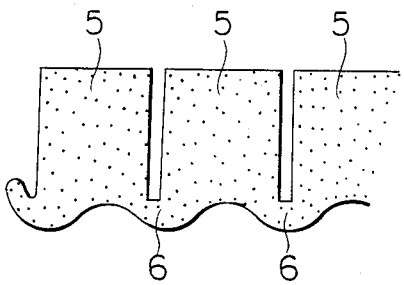
FIG. 3
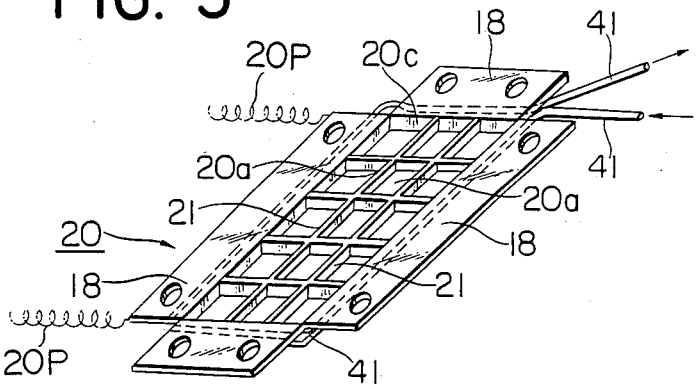
FIG. 4
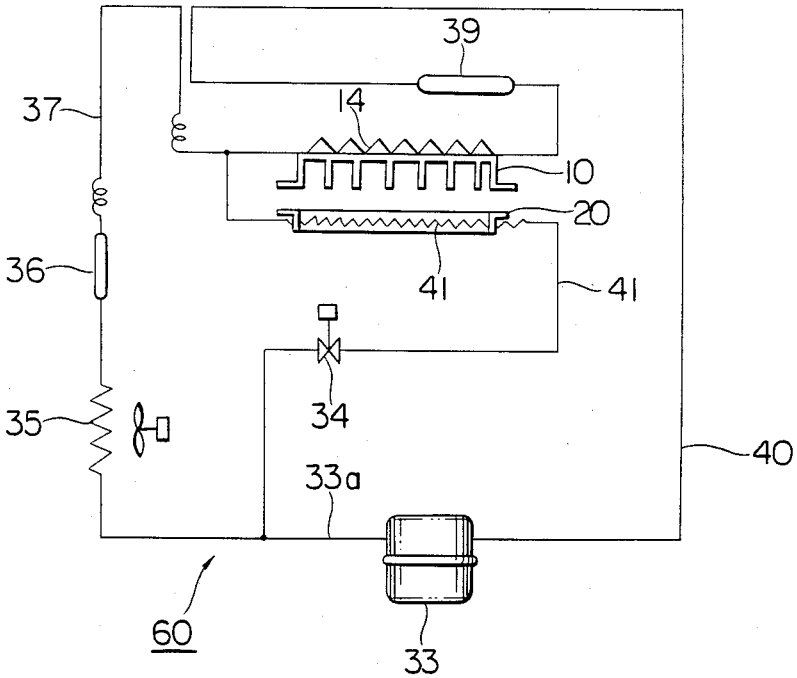

AUTOMATIC ICE MAKING MACHINE

BACKGROUND OF THE INVENTION

This invention relates to a cyclic and upward water jet type automatic ice making machine or apparatus. More particularly, it relates to an improvement in such machine or apparatus according to which ice cubes formed in respective cells of the freezing chamber are separated from one another when formed and are of a regular shape free of connecting portions and the state of termination of ice formation and the state of termination of harvesting may be positively achieved without regard to ambient temperature or other factors.

In FIG. 1A, there is shown a typical freezing chamber of the prior art apparatus. A number of chamber partitioning plates 2 formed of copper are welded to a freezing grid or chamber 1A formed of copper so that a large number of freezing grids are formed. Ice-making water is directed in jet upwardly towards the freezing grid for forming ice cubes 5 in the respective cells 3. FIG. 10 shows the ice cubes separated from the chamber 1.

In such a conventional system, both the freezing chamber and the partitioning plates are formed of a material of relatively high thermal conductivity. Hence, the free edges of the partitioning plates 2 are cooled to an ice-forming temperature so that some time interval elapses before the return water falls from this area as droplets. Moreover, this edge area 4 of each partitioning plate 2 is contiguous to the adjacent cell and the return water falling down both sides of the partitioning plate is united at the edge area of each partitioning plate 2. The result is that a thick ice layer is formed at the edge zone 4 of each partitioning plate 2. When the freezing chamber 1 is switched to harvesting, each ice cube 5 is connected to an adjoining ice cube by a connecting portion 6, and the ice tends to hang down in an icicle shape, thus making it difficult to achieve uniform ice cube shape and considerably detracting from the commercial value of the ice cubes. The ice cubes thus connected together do not separate into individual ice cubes solely from the impact caused by the ice cubes falling into the storage bin. This disadvantage proves to be fatal especially when the ice making machine is incorporated into an automatic ice cube vender in which a preset amount of the ice cubes is to be dispensed from the storage bin.

As a means for separating the thus connected ice cubes into individual ice cubes, it is known to use a cord heater (not shown) suitably connected with the aid of a heat insulating frame for melting and cutting the connecting portions of the ice cubes. However, this known system is inconvenient because of its excessive consumption of electrical power and difficulties in assemblying, servicing and maintaining cleanliness.

As a means of sensing the end of ice making, it is known to use a timer or a temperature sensor such as a thermostat or thermister for sensing temperature changes in the freezing chamber.

With these known means, the ice formed in the ice making machine is affected by changes in the ambient temperature both in the quality and the amount of the ice, thus making it necessary to provide an automatic device for adjusting the timer setting or temperature characteristics of the sensor. As a result thereof, the maintenance operation tends to be complex and the manufacturing costs are also increased. The end of harvesting can be detected by sensing temperature changes in the freezing chamber by temperature sensors, such as thermostats or thermisters. However, in general, these sensors are supplied as separate items from the sensor for sensing the termination of ice forming, thus further raising manufacturing costs.

SUMMARY OF THE INVENTION

It is a principal object of the present invention to provide a means for overcoming these difficulties, by providing an ice cutting frame with a hot gas pipe and ice-cutting partitioning plates similarly profiled to and mounted in opposition to the partitioning plates of the freezing chamber.

The ice-cutting frame is spaced a preset distance from the lower end of the freezing chamber so that the connecting portion between the adjacent ice cubes is melted and cut during the harvesting cycle by the ice-cutting partitioning plates of the cutting frame.

As a means of causing the ice cubes to positively drop during the harvesting cycle, the ice-cutting partitioning plates of the ice-cutting frame are of a lesser thickness than the partitioning plates of the freezing chamber so that descent of the ice cubes from the cells is not obstructed by the ice-cutting partitioning plates. Also the heat insulating frame and the heating frame are placed in juxtaposition beneath the freezing chamber, in such a manner that the partitioning plates of the heat insulating frame positioned in registration with the partitioning plates of the freezing chamber are effective in preventing ice products in the respective cells from being united with those of the adjoining cells at the free edge of the partitioning plates of the freezing chamber.

As means for positively effecting ice forming and harvesting operations, a temperature sensor such as a thermostat is provided on the cutting frame positioned at some distance away from the lower edge of the freezing chamber in such a manner that the acute drop in temperature in the ice-cutting frame caused by termination of ice formation in the freezing chamber is sensed by the temperature sensor. The rapid rise in temperature in the ice-cutting frame caused upon termination of harvesting in the freezing chamber is also sensed by the same temperature sensor that senses the end of ice formation in the freezing chamber.

BRIEF DESCRIPTION OF THE DRAWINGS

FIGS. 1A and 1B are a sectional side elevation and a side elevation, respectively showing a conventional ice making chamber and the ice formed therein.

FIG. 3 is a perspective view of the ice-cutting frame.

FIG. 4 shows the freezing circuit employed in the ice making machine shown in FIG. 3.

FIGS. 5A, 5B and 5C are sectional views showing the ice-making process, wherein FIG. 5A shows the state of the ice being formed, FIG. 5B the state of the ice-forming process about to be completed and FIG. 5C the state of the completed ice forming process.

FIGS. 10A to 10C are sectional view showing the ice-making process, wherein FIG. 10A shows the state of the ice being formed, FIG. 10B the state of the ice forming process about to be completed, and FIG. 10C the state the terminated ice forming process.

FIGS. 13A to 13C show a third embodiment wherein FIG. 13A shows an overall construction partially shown in section and FIGS. 13B and 13C show two alternate arrangements for the essential part shown in FIG. 13A.

FIGS. 14A to 14C are sectional view showing the ice making process, wherein FIG. 14A shows the state of the ice being formed, FIG. 14B the state of the ice forming process about to be completed and FIG. 14C the state of the completed ice forming process.

FIGS. 16 to 18 show a fourth embodiment wherein FIG. 16 shows the overall construction shown partially in section, FIG. 17 is a perspective view showing the heat-insulating frame and FIG. 18 is an enlarged sectional view showing essential parts of FIG. 16.

DESCRIPTION OF THE PREFERRED EMBODIMENT

Referring to the accompanying drawings, a preferred first embodiment of the automatic ice making machine or apparatus of the present invention is explained in detail.

Figure 2:
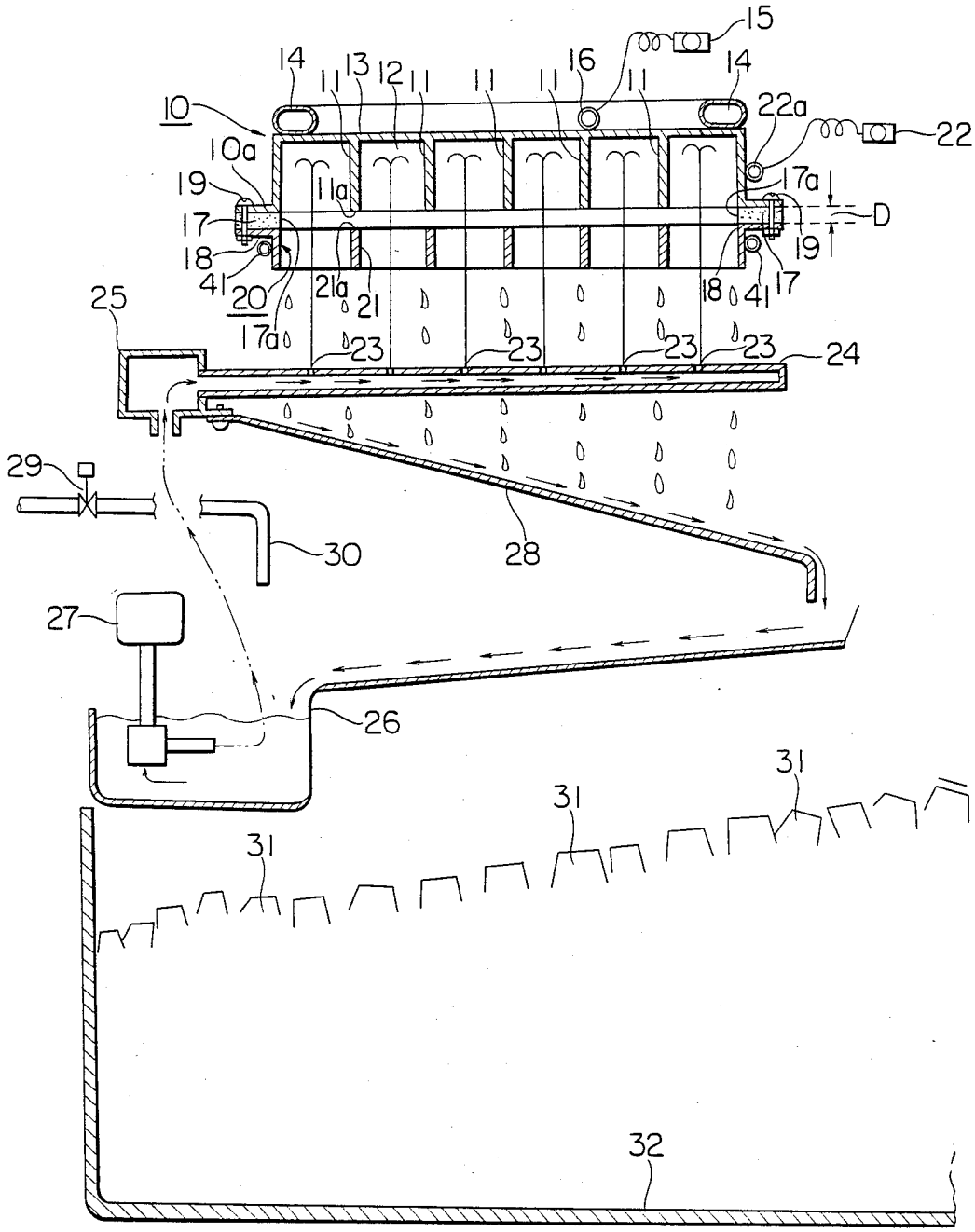
FIG. 2 is a sectional view showing the overall construction of the automatic ice making machine of the present invention.

Referring to FIG. 2, the numeral 10 designates a freezing grid or chamber in the form of a pan or a box and divided into a large number of freezing cells 12 by a plurality of chamber partitioning plates 11. An evaporator 14 and a sensor 16 of a freezing or ice-forming thermostat 15 are provided on an outer surface 13 of the freezing chamber 10. Beneath the freezing chamber 10, an ice-cutting frame 20 has its peripheral flange 18 secured to a peripheral flange 10*a* of the freezing chamber 10 with the intermediary of a heat insulating frame 17 by a plurality of bolts 19, only two being shown in FIG. 2. A plurality of ice-cutting partitioning plates 21 are formed in the ice-cutting frame 20 in opposition to and in correct registration with the partitioning plates 11 of the freezing chamber 10. The ice-cutting frame 20 is arranged in a manner shown in more detail in FIG. 3. Each square cell 20*a* defined by adjacent ice-cutting partitioning plates 21 is open on both the upper and lower surfaces thereof and in opposition to each freezing cell 12 of the freezing chamber 10. Also, since the ice-cutting frame 20 is secured to the freezing chamber 10 by the intermediary of the heat insulating frame 17, the lower ends 11*a* of the partitioning plates 11 and the upper ends 21*a* of the ice-cutting partitioning plates 21 are spaced apart from one another by a gap D equal to the thickness of the heat insulating frame 17. The inner sides 17*a* of the frame 17 are flush with the inner sides of the partitioning plates 11 and 21. The outer sides of the freezing chamber 10 are provided with a sensor 22*a* of a harvesting thermostat 22.

Beneath the freezing chamber 10, there are fixedly mounted a plurality of water spray pipe sections 24 each having a large number of water spray ports or foramina 23. The ice making water is sprayed in jets from these spray ports 23 upwards to about the center of each respective freezing cell 12. These water spray pipe sections 24 are connected to a water distributor 25 to which the ice making water supplied by an ice-making water pump 27 in an ice-making water tank 26 is introduced via a conduit, not shown, as indicated by the broken allows arrows in FIG. 2. The ice-making water falling from the freezing chamber 10 is returned to the tank 26 by way of an ice cube guide chute 28. The ice making water is supplied into the tank 26 by a water charging pipe 30 provided with a water charging valve 29. The ice cubes 31 formed in the freezing chamber 10 are stored in an ice product reservoir 32.

A freezing circuit used in the present embodiment is shown in FIG. 4 wherein a discharge pipe 33*a* of a compressor 33 is connected to a condenser 35, from which the gaseous cooling medium is supplied to an evaporator 14 by way of a drier 36 and a capillary tube 37. The gaseous cooling medium is returned to the compressor 33 through an accumulator 39 and a suction pipe 40. A hot gas is supplied to a hot gas pipe 41 which is branched from the discharge pipe 33*a* and placed around the cutting frame 20. The hot gas pipe 41 has a hot gas valve 34 and is connected to the evaporator 14.

Furthermore, said ice cutting frame is able to be made of an electro-conductive material, i.e. electro-conductive resin, instead of metal material of said cutting frame 20 and to be provided with a pair of lead wires 20P as shown in an imagination line in FIG. 3. Therefore, in this case, said ice cutting frame 20 of electro-conductive material is heated by a supply of electric power source (not shown) and able to employ said ice cutting frame for other embodiments of the present invention as the same.

In the ice-making operation of the above described ice making machine of the present invention, the gaseous cooling medium is compressed by the compressor 33 and supplied via discharge pipe 33*a* to the condenser 35 where it is condensed. After the pressure is reduced in the capillary tube 37, the cooling medium is supplied into the evaporator 14 for effecting heat absorption in the freezing chamber 10. The cooling medium is separated in the accumulator 39 into a gaseous phase and a liquid phase and the gaseous phase is returned by way of the suction pipe 40 into the compressor 33.

Figure 5:
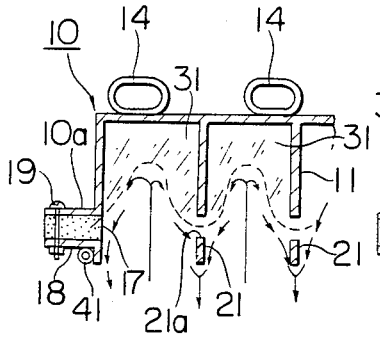
Figure 5:
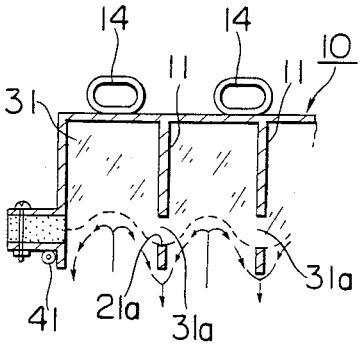
Figure 5:
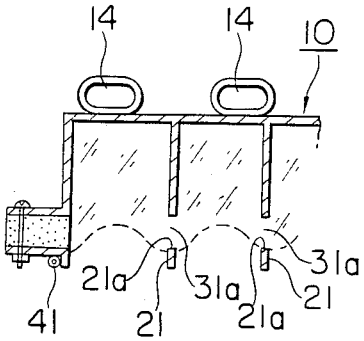

The freezing chamber 10 is cooled by the repetition of the above described cyclic operation. The ice making water is sprayed into the respective freezing cells 12 via spray ports 23 provided in the water spray pipe 24 by the operation of the ice-making water pump 27 provided within the ice-making water tank 26. A part of the ice-making water is frozen by heat exchange with the cooling medium, while the remaining ice-making water is caused to fall down along the ice guide chute 28 to be returned into the ice-making water tank 26. In this manner, ice starts to be formed within each ice-making cell 12. With progress in the ice formation, ice is also formed on the lower ends 11*a* of the partitioning plates 11 and the pre-termination state of ice-making shown in FIG. 5B is reached through the intermediate state of ice making shown in FIG. 5A. In the pre-termination state, ice cubes 31 in the neighboring cells 12 are joined together in the form of icicles at a connecting or junction portion 31*a*. In the completed state of ice making shown in FIG. 5C, the junctions 31*a* formed between adjacent ice blocks 31 reach the gap D between the partitioning plates 11 and 21. In this state, the ice-making thermostat 15 senses the termination of the ice making to stop the operation of the ice-making water pump while opening the hot gas valve 34 so as to supply the hot gas into the evaporator 14 through the hot gas pipe 41 for initiating the harvesting cycle. At this time, the water charging valve 29 is also opened for supplying the ice-making water into the ice-making water tank 26. Since the ice-cutting frame 20 is formed of heat conducting material and thermally insulated from the freezing chamber 10 by the gap D and the heat insulating frame 17, the ice-cutting frame 20 is not cooled to as low a temperature as that of the freezing chamber 10, but rather it may be heated to a higher temperature in a short time by the hot gas flowing in the hot gas pipe 41.

When the harvesting cycle is initiated, the freezing chamber 10 is also heated gradually by the hot gas so that the ice cubes 31 start to melt. The temperature of the ice-cutting frame 20 is low as long as the junction portion 31*a* clings to the ice-cutting frame 20, but when the junction portion 31*a* melts as shown in FIG. 6A, the temperature of the ice-cutting frame will rapidly rise while that of the hot gas flowing into the evaporator 14 will also rise acutely. In this manner, the heating of the freezing chamber 10 is promoted so that the contact surfaces of the ice cubes 31 within the freezing chamber 10 is melted completely as shown in FIG. 6B. Thus the ice cubes start to descend gradually under their own weight.

Although ice is also formed on the heat insulating frame 17, it is easily melted during the harvesting cycle under the effect of heating of the ice-cutting frame 20 by the hot gas flowing in the hot gas pipe 41.

Figure 6:
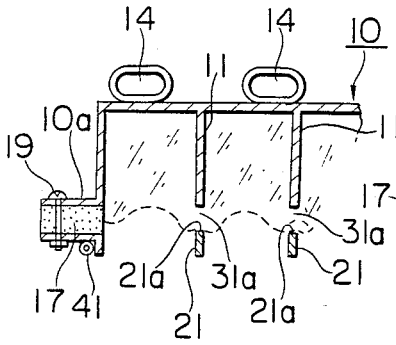
FIGS. 6A, 6B, 6C, 6D and 6E are sectional views showing the harvesting process.
Figure 6:
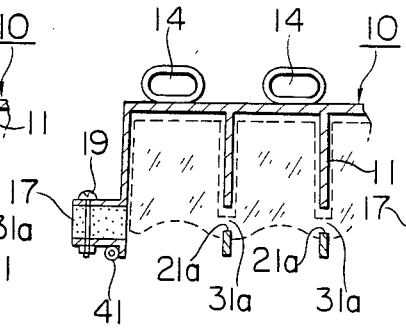
Figure 6:
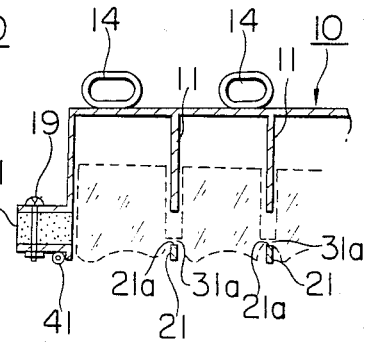
Figure 6:
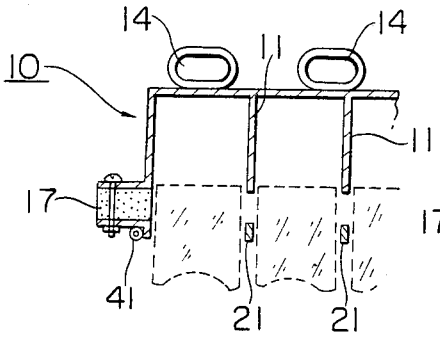
Figure 6:
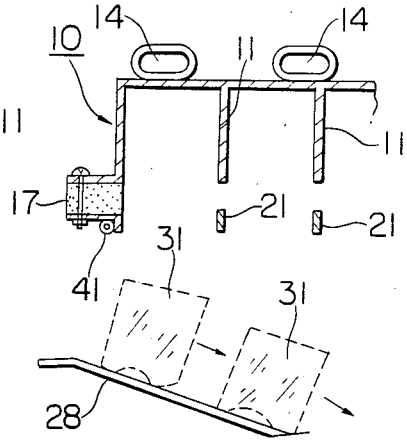

When the ice cubes 31 start to descend under their own weight, the junction portion 31*a* formed between the freezing chamber 10 and the ice-cutting frame 20 is disposed on the upper end parts 21*a* of the ice-cutting partitioning plates 21, as shown in FIG. 6C. Since the ice-cutting partitioning plates are at a higher temperature at this time, the junction portions 31*a* are melted immediately and the ice cubes 31 thereby fall down from the cells 12 as shown at D in FIG. 6, the ice cubes 31 presenting smooth sides free of protuberances so that a number of ice cubes with approximately regular cube form as shown in FIG. 6E are obtained one after another. When the ice cubes 31 have detached and fallen from the freezing chamber 10, the temperature of the freezing chamber 10 rises acutely so that the harvesting thermostat 22 is activated and the hot gas valve 34 is closed while the ice-making water pump 27 is again driven into operation for starting the next freezing cycle.

In the above described construction and operation of the present invention, by keeping the junction portion between adjacent ice cubes namely the portion to be cut, at a minimum thickness the ice-making capability is improved by reducing the ice-cutting time. Such removal of the junction portions may be effected without using any specified additional thermal energy and by simply using the energy inherent in the automatic ice making machine. The ice cubes are in approximately regular cube form and the operational reliability of the ice making machine of this type is also improved. The ice cubes are separated from each other when falling from the freezing chamber, so that the inconvenience of the ice products only partially melting and remaining united to one another in the reservoir is dissolved completely. In the present embodiment, although the ice-cutting frame is attached to the freezing chamber through the medium of the heat insulating material, a similar effect may be derived when the main body is fitted with the ice-cutting frame in any suitable manner for providing the abovementioned gap D. Also, in the present embodiment, while the stationary water spray pipe sections are used, the present invention may also be applied to an ice-making machine or apparatus making use of an opened or closed type water tray.

The second embodiment of the automatic ice-making machine or apparatus according to the present invention will now be explained in detail by referring to FIGS. 7 to 12E. In these figures, the same numerals are used to denote the same or equivalent parts.

Figure 7:
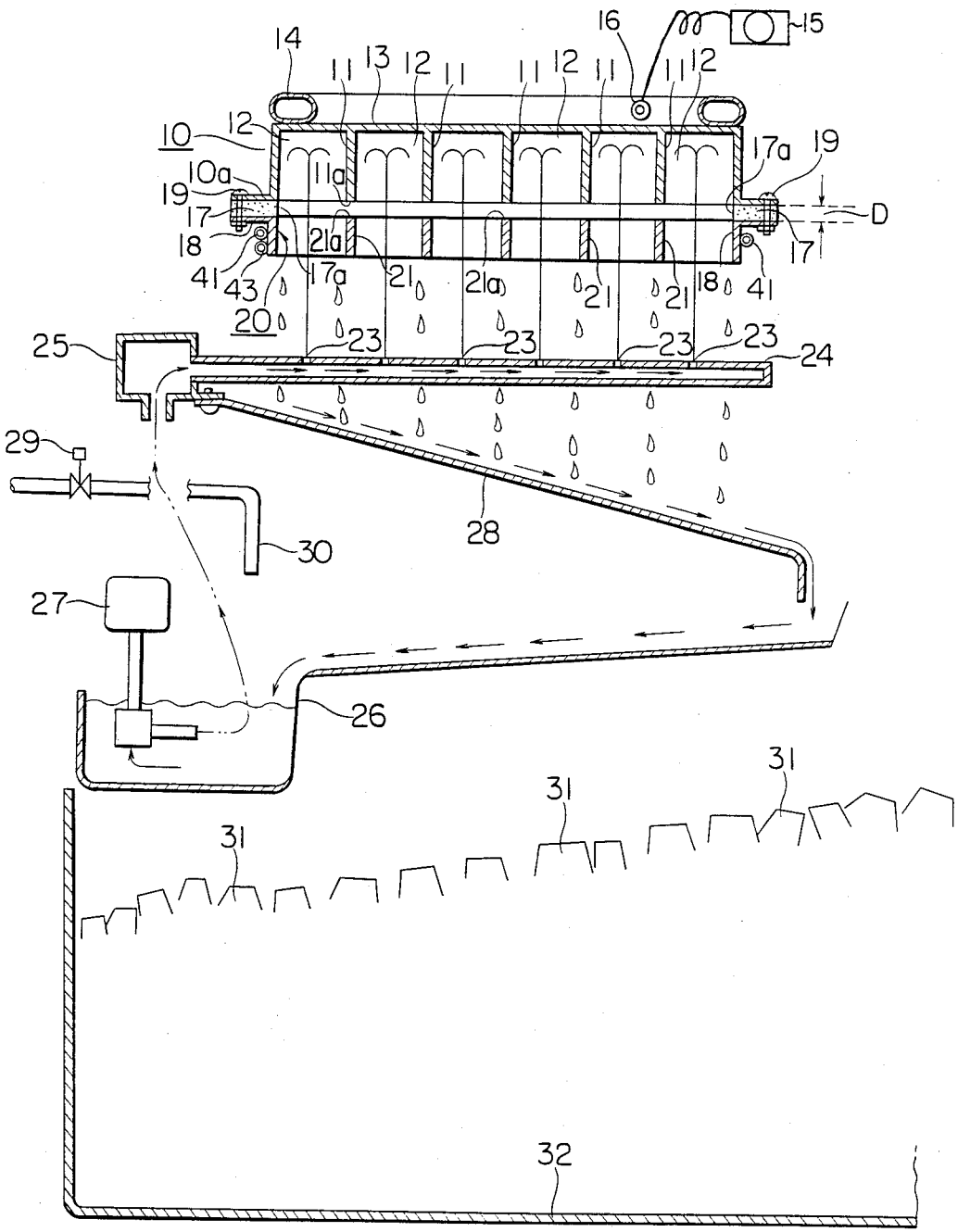
FIG. 7 is a sectional view showing the overall construction of a second embodiment of the present invention.

In FIG. 7, the numeral 10 designates a freezing grid or chamber in the form of a pan or a box and divided into a large number of freezing cells 12 by a plurality of partitioning plates 11. An evaporator 14 and a sensor 16 are provided on an outer surface 13 of the freezing chamber 15. Beneath the freezing chamber 10, an ice-cutting frame 20 has its peripheral flange 18 secured to a peripheral flange 10*a* of the freezing chamber 10 with the intermediary of a heat insulating frame 17 by means of plural bolts 19, only two of which are shown in FIG. 2. A plurality of ice-cutting partitioning plates 21 are formed in the ice-cutting frame 20 in opposition to and in correct registration with the partitioning plates 11 of the freezing chamber 10. The ice-cutting frame 20 is arranged in a manner similar to the preceding embodiment and as shown in more detail in FIG. 3. Each freezing cell 20*a* defined by adjacent ice-cutting partitioning plates 21 is open on both the upper and lower sides and in opposition to each freezing cell 12 of the freezing chamber 10. Also, since the ice-cutting frame 20 is secured to the freezing chamber 10 with the heat insulating frame 17 interposed between the flanges 10*a* and 18, the lower ends 11*a* of the partitioning plates 11 and the upper ends 21*a* of the ice-cutting partitioning plates 21 are spaced apart from one another by a gap D equal to the thickness of the frame 17. The inner side 17*a* of the frame 17 is flush with the inner sides of the partitioning plates 11 and 21.

Beneath the freezing chamber 10, there are fixedly mounted a plurality of water spray pipe sections 24 each having a large number water spray ports 23. The ice making water is sprayed in jets from these spray ports 23 upwards to about the center of each respective freezing cell 12. These water spray pipe sections 24 are connected to a common water distributing chute 25 to which the ice making water supplied by an ice-making water pump 27 provided in an ice-making water tank 26 is introduced via a conduit, not shown, as indicated by the broken arrows in FIG. 7. The ice-making water falling from the freezing chamber 10 is returned to tank 26 by way of ice cube guide chute 28. The ice making water is supplied into tank 26 by a water charging pipe 30 provided with a water charging valve 29. The ice cubes formed in the freezing chamber 10 are stored in an ice product reservoir 32.

Figure 8:
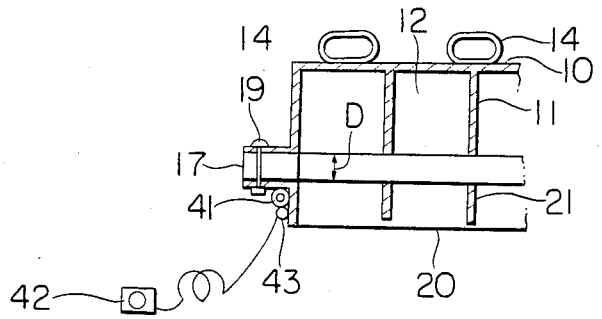
FIG. 8 is an enlarged sectional view showing essential parts of FIG. 7.

A freezing circuit employed in the present embodiment is shown in FIG. 4, wherein a discharge pipe 33*a* of a compressor 33 is connected to a condenser 35 from which the gaseous cooling medium is supplied to an evaporator 14 by way of a drier 36 and a capillary tube 37. The gaseous cooling medium is returned to the compressor 33 through an accumulator 39 and a suction pipe 40. A hot gas is supplied to the hot gas pipe 41 which is branched from the discharge pipe 33*a* and placed around the cutting frame 20. The hot gas pipe 41 has a hot gas valve 34 and is connected to the evaporator 14. As best shown in FIG. 8, a temperature sensor 43 having a switch contact 42 for sensing the temperature for the termination of ice formation and the temperature for the end of harvesting is attached to the lower side of the hot gas pipe 41 placed around the cutting frame 20. The sensor 43 issues a termination of ice formation signal when it has detected that the temperature of the icecutting frame 20 is lower than a predetermined value, and an end of harvesting signal when it has detected that the temperature exceeds a predetermined value after the ice cubes have fallen from the freezing chamber.

Figure 9:
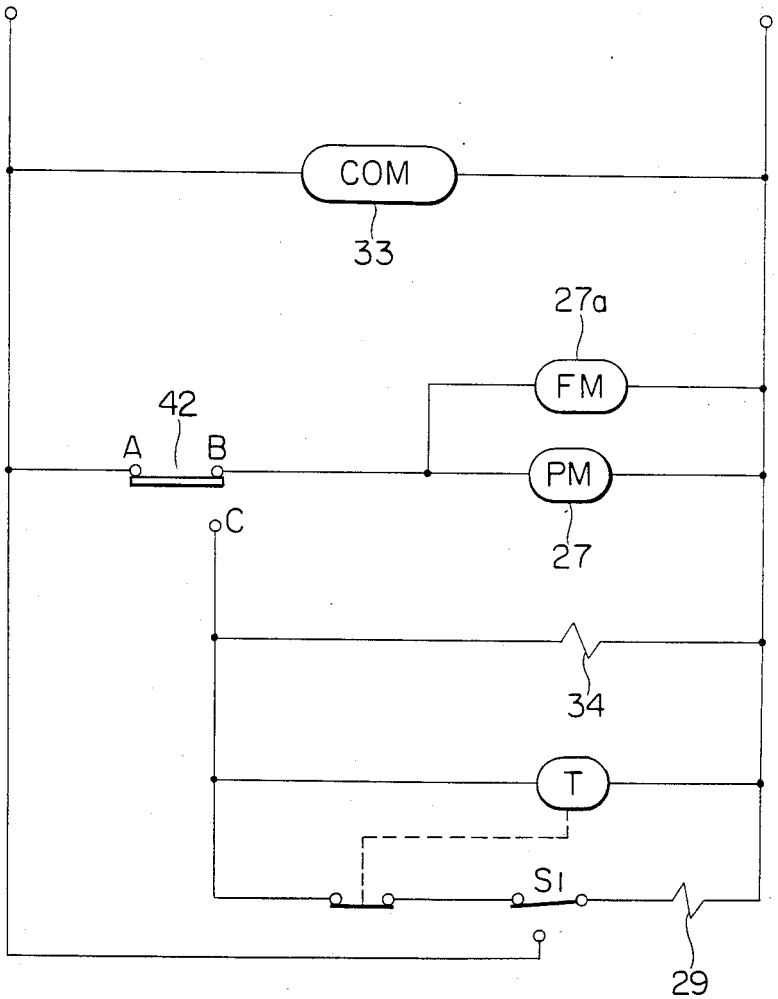
FIG. 9 is an electric circuit diagram of the electrical system shown in FIG. 7.

FIG. 9 shows an example of the electric circuit employed in the second embodiment of the automatic ice-making machine of the present invention. An actuating switch $S_1$ not shown in FIGS. 7 and 4 is used for initial charging of the ice-making water. When terminals A and B of the change-over contact 42 of the temperature sensor 43 are closed, the machine is in the ice-making cycle and, when terminals A and C of the change-over contact 42 are closed, the machine is in the harvesting cycle.

Figure 10:
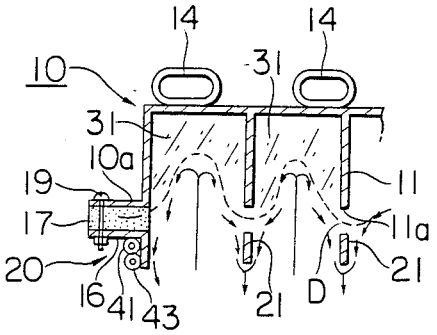
Figure 10:
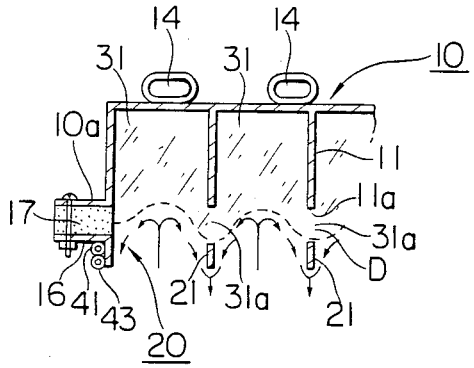
Figure 10:
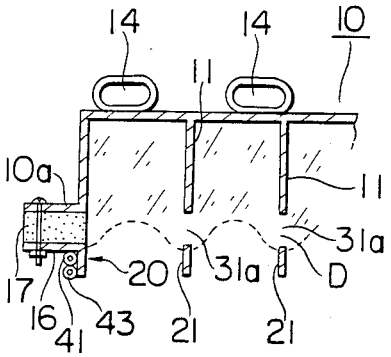
Figure 11:
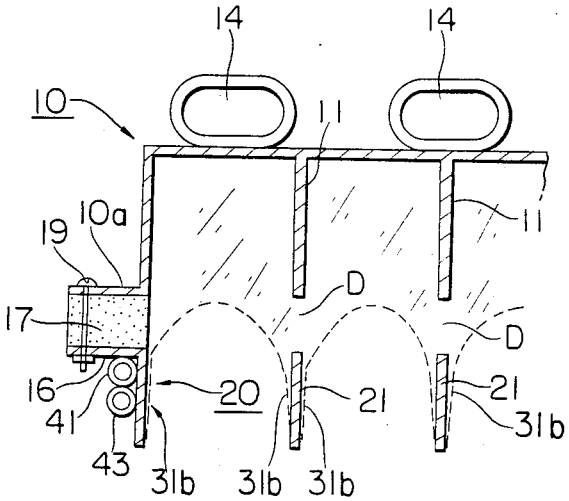
FIG. 11 is a detailed sectional view showing in more detail the completed ice forming state.
Figure 12:
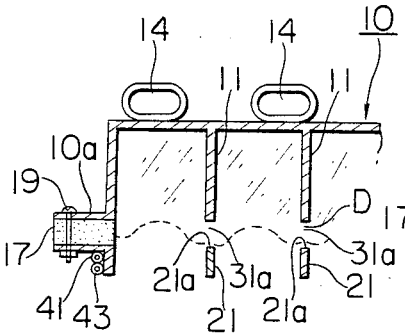
FIGS. 12A, 12B, 12C and 12E are sectional views showing the harvesting process.
Figure 12:
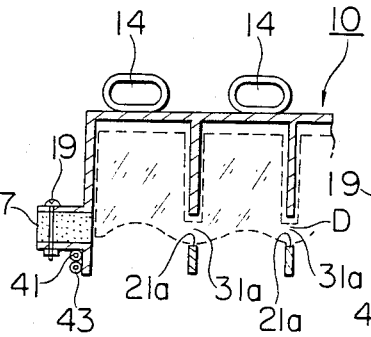
Figure 12:
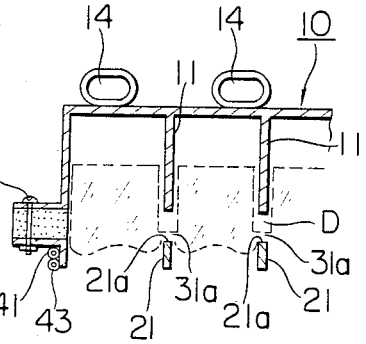
Figure 12:
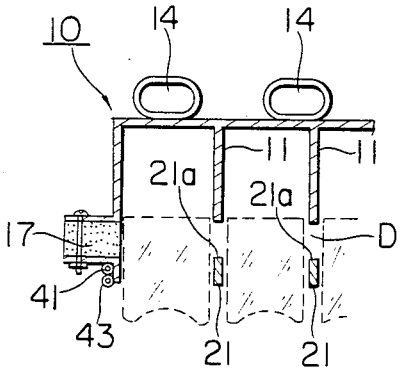
Figure 12:
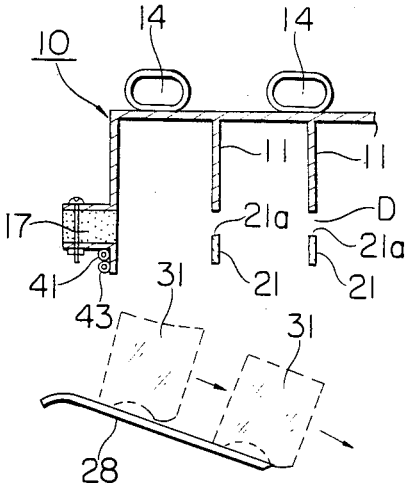

In the ice-making operation of the above described ice making machine or apparatus according to the second embodiment of the present invention, the gaseous cooling medium is compressed by the compressor 33 and supplied via discharge pipe 33*a* to the condenser 35 where it is condensed. After the pressure is reduced in the capillary tube 37, the cooling medium is supplied into the evaporator 14 for effecting heat absorption in the freezing chamber 10. The cooling medium is separated in the accumulator 39 into a gaseous phase and a liquid phase and the gaseous phase is returned by way of the suction pipe 40 into the compressor 33. The freezing chamber 10 is cooled by repetition of the above described cyclic operation. The ice making water is sprayed in jets into the respective freezing cells 12 via spray ports or foramina 23 in the water spray tube sections 24 by means of the ice-making water pump 27 provided within the ice-making water tank 26. A part of the ice-making water is frozen by heat exchange with the cooling medium, while the remaining ice-making water is caused to flow down along the ice guide chute 28 to be returned into the ice-making water tank 26. In this manner, ice starts to be formed within each ice-making cell 12. As the ice-making progresses, ice is also formed on the lower ends of the partitioning plates 11, and the pre-termination state of ice making as shown in FIG. 10B is reached through the intermediate state of ice making shown in FIG. 10A. The cutting frame 20 is spaced apart from the chamber 10 by the gap D and thermally insulated therefrom by the frame 17, while it is also cooled by the falling water (return water) which has not been frozen in the freezing cells 12. Hence, the frame 20 does not reach the low freezing temperature, but is maintained at a temperature approximately equal to that of the falling water (about 0° C.). With further progress in the freezing cycle, the end of the ice formation state as shown in FIG. 10C is reached. At this time, a part of the ice on the lower end parts 11*a* of the partitioning plates 11 of the freezing chamber 10 is formed to a thickness larger than the gap D between the ice-cutting frame 20 and the freezing chamber 10 so that it reaches the ice-cutting partitioning plates 21 of the ice-cutting frame 20. Thus, as shown in FIG. 11, thin ice layers 31*b* start to be formed on the surfaces of the ice-cutting partitioning plates 21. When the thin ice layers 31*b* start to form on the plates 21, the temperature of the overall ice-cutting frame 20 formed of heat conducting material starts to drop rapidly. At this time, the end of ice formation state shown in FIG. 10 has already been reached so that the ice-cutting frame 20 is at a temperature of 0° C. to −3° or −4° C. This low temperature state is immediately sensed by the temperature sensor 43 so that its contact 42 (See FIG. 9) is shifted from A-B to A-C. Thus the ice-making water pump 27 and fan motor 27*a* are stopped and the hot gas valve 34 is opened for initiating the harvesting cycle.

When the harvesting cycle is initiated, the freezing chamber 10 is also heated gradually so that the ice cubes 31 start to melt. The temperature of the ice-cutting frame 20 is low as long as the junction portions 31*a* of the ice blocks 31 are affixed to the ice-cutting frame. However, when the junction portions 31*a* are melted as shown in FIG. 12A, the temperature of the ice-cutting frame is raised rapidly while the temperature of the hot gas flowing in the evaporator 14 is also elevated promptly for promoting heating of the freezing chamber 10. Thus, the contact surfaces of the ice cubes 31 within the freezing chamber are melted as shown in FIG. 12B and the ice cubes start to fall down under their own weight.

Although the ice is also formed on the heat insulating frame, it is entirely melted during the harvesting cycle under the effect of heating of the cutting frame 20 by the hot gas flowing in the hot gas pipe 41.

When the ice cube 31 starts to fall under their own weight, the junction portions 31*a* formed between the freezing chamber 10 and the ice-cutting frame 20 is disposed on the upper end parts 21*a* of the ice-cutting partitioning plates 21, as shown in FIG. 12C. Since the cutting partitioning plates are at a higher temperature at this time, the junction portions 31*a* are melted immediately and the ice cubes thereby fall down from the cells 12 as shown in FIG. 12D so that the ice cubes 31 present smooth sides free of protuberances and a number of ice cubes with approximately regular cube form as shown in FIG. 12E are obtained one after another. As soon as the harvesting cycle is initiated, the water charging valve 29 is opened for a preset time for charging the ice-making water. When the ice cubes 31 have fallen from the freezing chamber 10 through the ice-cutting frame 20, the temperature of the cutting frame 20 is elevated acutely so that the change-over contact 42 of the temperature sensor 43 is switched from A-C to A-B. In this manner, the hot gas valve 34 is closed and the ice-making water pump 27 as well as the fan motor 27*a* driven into operation for starting the next ice-making cycle.

With the above described construction and operation of the ice making machine or apparatus according to the second embodiment of the present invention, the end of ice formation state and the end of harvesting state can be sensed positively by means of a single temperature sensor which senses the acute rise and fall of the temperature of the ice-cutting frame. The sensing may be performed without regard to ambient temperature and without the need of any other specified devices.

Also, ice cubes of uniform size and shape may be obtained at reduced costs and without regard to ambient temperature, while an improvement is also achieved in the operational reliability of the ice-making machine or apparatus.

Referring to FIGS. 13A through 15E, the automatic ice making machine according to a third embodiment of the present invention is explained.

Referring to FIG. 13A, the numeral 10 designates a freezing chamber in the form of a pan or a box and divided into a large number of freezing cells 12 by a plurality of partitioning plates 11. An evaporator 14 and a sensor 16 of a freezing or ice-forming thermostat 15 are provided on an outer surface 13 of the freezing chamber 10. Beneath the freezing chamber, an ice-cutting frame 20 has its peripheral flange 18 secured to a peripheral flange 10*a* of the freezing chamber 10 with the intermediary of a heat insulating frame 17 by a plurality of bolts 19, only two of which are shown in FIG. 13A. A plurality of ice-cutting partitioning plates 21 are formed in the ice-cutting frame 20 in opposition to and in correct registration with the partitioning plates of the freezing chamber 10. The cutting frame 20 is arranged in the same manner as in the first embodiment and as shown in more detail in FIG. 3. Each square cell 20*a* defined by adjacent ice-cutting partitioning plates 21 is open on both the upper and lower sides and in opposition to each freezing cell 12 of the freezing chamber 10. Also, since the ice-cutting frame 20 is secured to the freezing chamber 10 by the intermediary of the heat insulating frame 17, the lower ends of the positioning plates 11 and the upper ends 21*a* of the ice-cutting partitioning plates 21 are spaced apart from one another by a gap D equal to the thickness of the heat insulating frame 17. The inner side 17*a* of the frame 17 is flush with the inner side 20*c* of a side section 20*b* of the ice-cutting frame 20. Thus, the inner side 20*c* of the side section 20*b* of the ice-cutting frame 20 and the inner side 17*a* of the frame 17 are offset outwards from the inner side 10*c* of the side section 10*b* of the freezing chamber 10 for forming a step, while the partitioning plate 11 of the freezing chamber 10 has a thickness T larger than the thickness E of the ice-cutting partitioning plate 21 of the ice-cutting frame 20. In this manner, the bottom surface of a square cell 20*a* of the ice-cutting frame 20 has a larger area than that of a lower opening 50 of the freezing cell 12.

Figure 13:
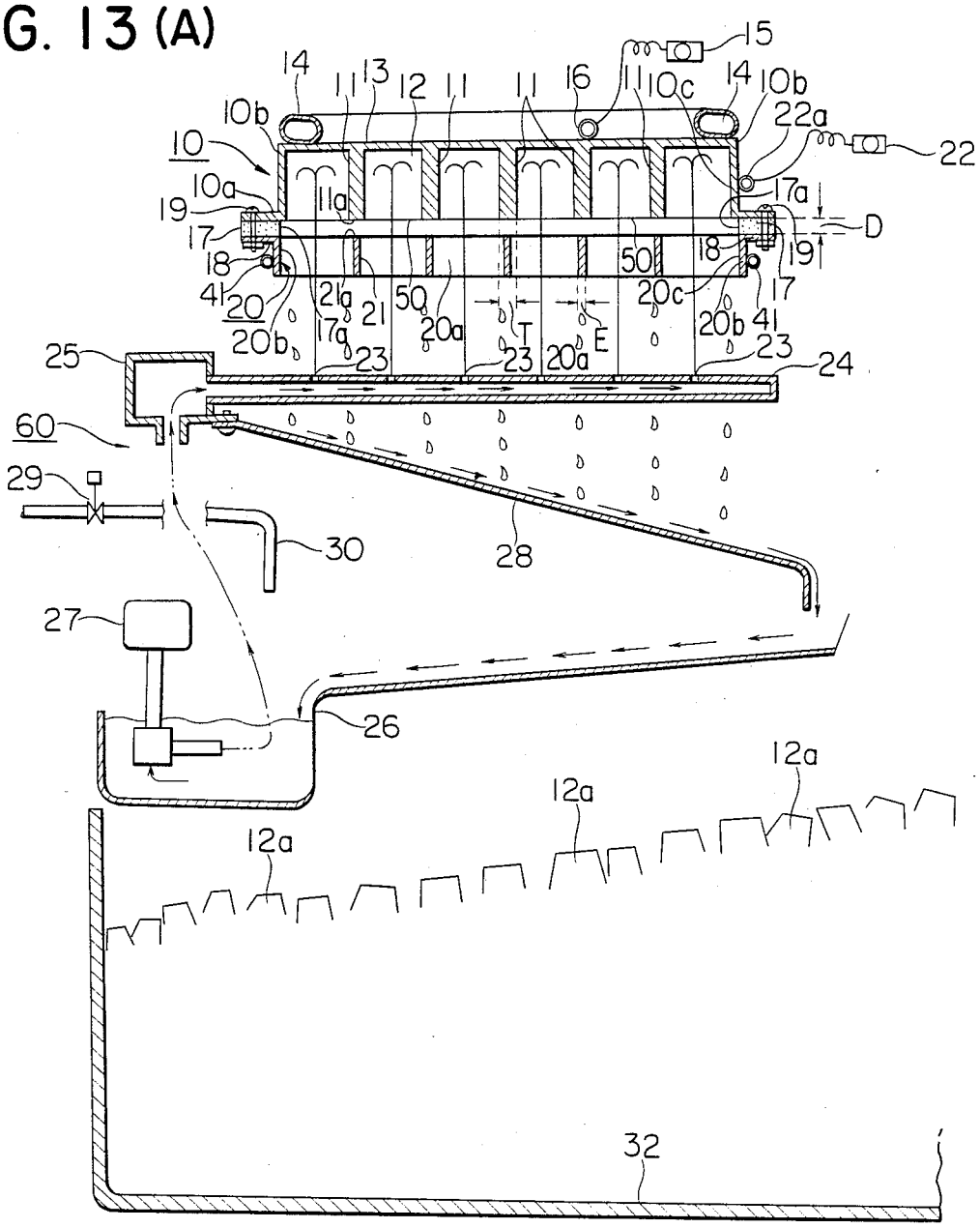
Figure 13:
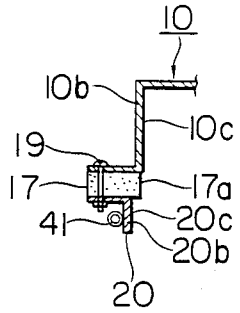
Figure 13C:
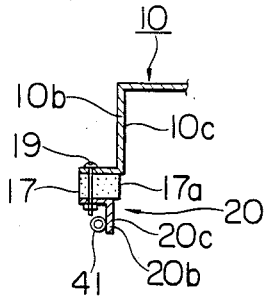
Figure 14:
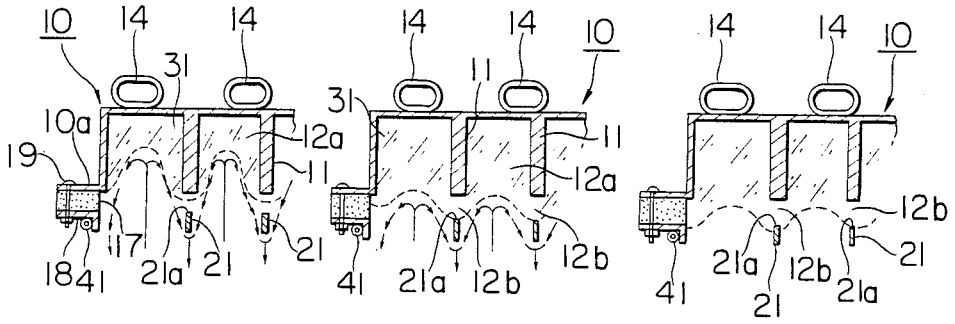

The relative position between the inner side 10*c* of the side section 10*b* of the freezing chamber 10, the inner side 20*c* of the side section 20*b* of the ice-cutting frame 20 and the inner side 17*a* of the heat-insulating frame 17, is not limited to that shown in FIG. 13A. For example, the arrangement shown in FIG. 13B wherein the inner sides 17*a* and 10*c* are flush with each other and the inner side 20*c* is outwardly offset from the sides 17*a* and 10*c*, or that shown in FIG. 13C wherein the inner sides 10C, 17*a* and 20*c* are stepped outwards in this order are also preferred because the descent of the ice cubes 12*a* is facilitated similarly to the above described embodiment shown in FIG. 13A.

To the outer sides of the freezing chamber 10 is fitted a harvesting thermostat 22 having a temperature sensor 22*a*. To the lower part of the freezing chamber 10 are fixedly mounted a plurality of water spray pipe sections 24 each having a large number of water spray ports 23. The ice-making water is sprayed from these spray ports 23 upwards in jets to about the center of the respective freezing cells 12. These water spray pipe sections 24 are connected to a common water distributing chute 25 to which the ice making water supplied by ice-making water pump 27 provided in an ice-making water tank 26 is introduced via a conduit, not shown, as indicated by the broken arrows in FIG. 13A. The ice-making water falling from the freezing chamber 10 is returned to tank 26 by way of ice cube guide chute 28. The ice-making water is supplied into tank 26 by a water charging pipe 30 provided with a water charging valve 29. The ice cubes 12*a* formed in the freezing chamber 10 are stored in an ice product reservoir 32.

A freezing circuit used in the present embodiment is shown in FIG. 4, wherein a discharge pipe 33*a* of a compressor 33 is connected to a condenser 35, from which the gaseous cooling medium is supplied to an evaporator 14 by way of a drier 36 and a capillary tube 37. The gaseous cooling medium is returned to the compressor 33 through an accumulator 39 and a suction pipe 40. A hot gas is supplied to a hot gas pipe 41 which is branched from the discharge pipe 33*a* and placed around the ice-cutting frame 20. The hot gas pipe 41 acting as heating means has a hot gas valve 34 and is connected to the evaporator 14. An ice-making section 50 is made up of the aforementioned compressor 33, condenser 35, evaporator 14 and the ice making water tank 26.

In the ice-making operation of the automatic ice-making machine or apparatus according to the third embodiment of the present invention, the gaseous cooling medium is compressed by the compressor 33 and supplied via discharge pipe 33*a* to the condenser 35 where it is condensed. After the pressure is reduced in the capillary tube 37, the cooling medium is supplied into the evaporator 14 for effecting heat absorption in the freezing chamber 10. The cooling medium is separated in the accumulator 39 into a gaseous phase and a liquid phase and the gaseous phase is returned by way of the suction pipe 40 into the compressor 33. The freezing chamber 10 is cooled by repetition of the above described cyclic operation. The ice making water is sprayed into the respective freezing cells 12 via spray ports 23 provided in the water spray pipe sections 24 by the operation of the ice-making water pump 27 provided within the ice making water tank 26. A part of the ice-making water is frozen by heat exchange with the cooling medium, while the remaining ice-making water is caused to fall down along the ice guide chute 28 to be returned into the ice-making water tank 26. In this manner, the ice starts to be formed within each ice-making cell 12. With progress in the ice making, ice is also formed on the lower ends 11*a* of the partitioning plates 11 and the pre-termination state of ice making shown in FIG. 14B is reached through the intermediate state of ice making shown in FIG. 14A. In the pretermination state, ice blocks 12*a* in the adjacent cells 12 are joined together in the form of icicles. In the completed state of ice making shown in FIG. 14C, the junction portion 12*b* formed between the adjacent ice blocks 12A reaches the gap between the partitioning plates 11 and 21. In this state, the ice-making thermostat 15 senses the termination of ice making. This causes the operation of the ice-making water pump to be discontinued, while opening the hot gas valve 34 for supplying the hot gas into the evaporator 14 through the harvesting cycle. At this time, the water charging valve 29 is also opened for charging the ice-making water into tank 26. Since the ice-cutting frame 20 is formed of heat conducting material and also thermally insulated from the freezing chamber 10 by the gap D and the heat insulating frame 17, the ice-cutting frame 20 is not cooled to as low a temperature as that of the freezing chamber 10, but may be heated to a higher temperature in a short time by the hot gas flowing in the hot gas pipe 41.

When the harvesting cycle is initiated, the freezing chamber 10 is also heated gradually by the hot gas so that the ice cubes 12*a* start to melt. The temperature of the ice-cutting frame 20 is low as long as the junction portion 12*b* is affixed to the ice-cutting frame. However, when the junction portion 12*b* is melted as shown in FIG. 15A, the temperature of the ice-cutting frame will rise rapidly while the temperature of the hot gas flowing in the evaporator 14 is also raised promptly and the heating of the freezing chamber 10 is promoted so that the contact surfaces of the ice cubes 12*a* within the freezing chambers are melted completely as shown at FIG. 15B. Thus the ice cubes start to fall down under their own weight.

Although ice is also formed on the heat insulating frame 17, it is easily melted during the harvesting cycle under the effect of heating of the ice-cutting frame 20 by the hot gas flowing in the hot gas pipe 41.

Figure 15:
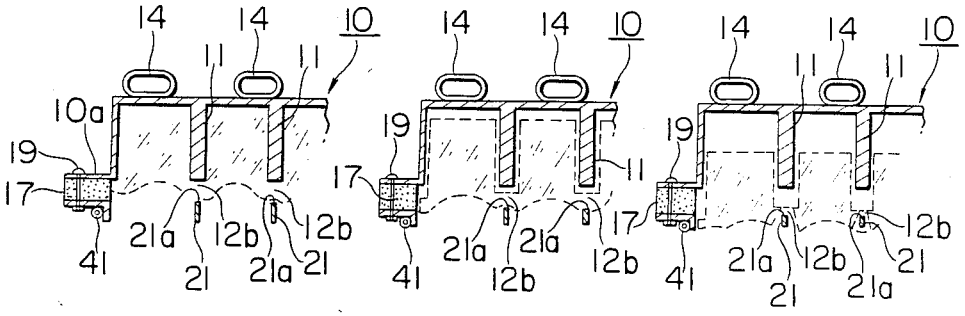
FIGS. 15A, 15B, 15C, 15D and 15E are sectional views showing the harvesting process.
Figures 15, 15E:
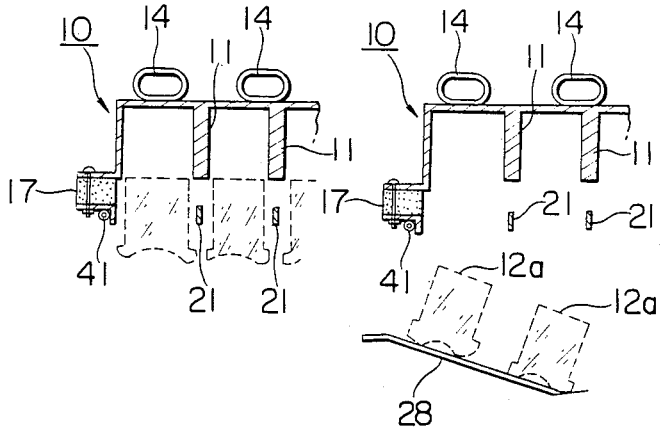

When the ice cubes 12*a* start to fall under their own weight, the junction portions 12*b* formed between the freezing chamber 10 and the ice-cutting frame 20 are disposed on the upper end parts 21*a* of the ice-cutting partitioning plates 21, as shown in FIG. 15B. Since the ice-cutting partitioning plates 21 are at a higher temperature at this time, the junction portions 12*b* are melted immediately and the ice cubes 31 thereby flow down from the cells 12 as shown in FIG. 15D so that a number of ice cubes with approximately regular cube forms as shown in FIG. 15E are obtained one after another. When the ice cubes 12*a* have been detached and fallen from the freezing chamber 10, the temperature of the chamber 10 is raised rapidly so that the harvesting thermostat 22 is activated for closing the hot gas valve 34 while the pump 27 is again driven into operation for starting the next harvesting cycle.

Although the hot gas is used in the present embodiment as heating means for the ice-cutting frame, a similar effect may also be obtained by using electrical heating. The freezing chamber is not limited to the one shown and described above. Thus, a freezing tray having a number of freezing cells formed of discrete cup-shaped elements opened towards the bottom may also be used with the ice making machine of the present invention.

With the above described construction and operation of the automatic ice making machine or apparatus, the thickness of the junction or the connecting portions of the ice cubes to be cut by the ice-cutting frames is minimized for possibly shortening the ice-cutting time and elevating the freezing efficiency. The partitioning plates of the freezing chamber are larger in thickness as compared to the ice-cutting partitioning plates of the ice-cutting frame so that the area of contact between the partitioning plate of the freezing chamber with the inner surface of the outer side of the freezing chamber is enlarged with the result that the heat conduction to the partitioning plates is improved. Hence, the freezing capacity is improved and the freezing time shortened during the freezing cycle, while the ice melting capacity is improved during the harvesting cycle to shorten the harvesting time.

The opening area of the square cells of the ice-cutting frame is larger than the lower opening area of the freezing cells, so that the connecting portions of the ice cubes can be positively cut when the ice cubes are descending even if there are small errors in the positioning of the heat insulating frame or the ice-cutting frame in respect to the freezing chamber resulting from assembly of the freezing chamber, and as a result the automatic ice cube making machine or apparatus may be fabricated easily at lower costs in a shorter time.

Figure 16:
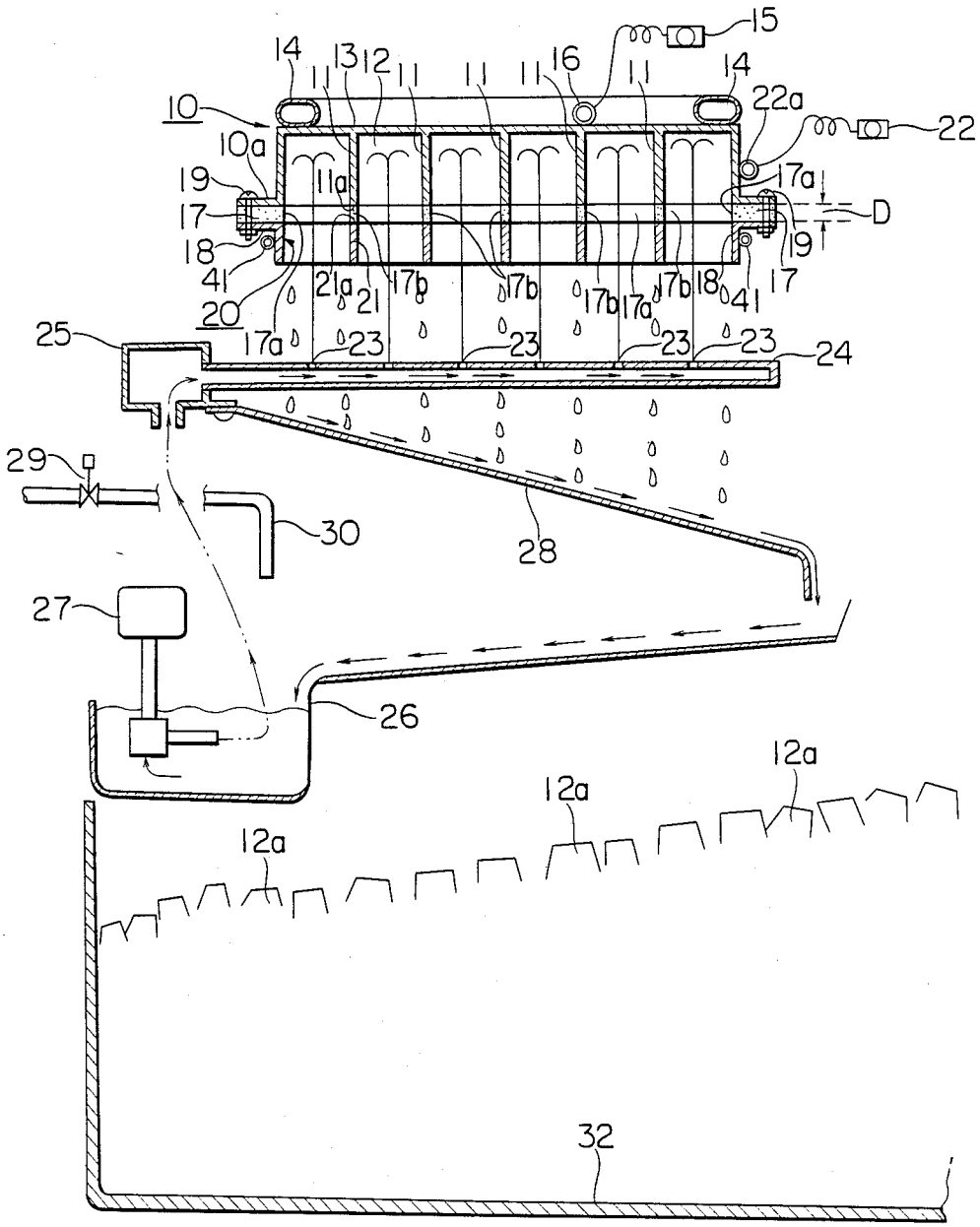
Figure 17:
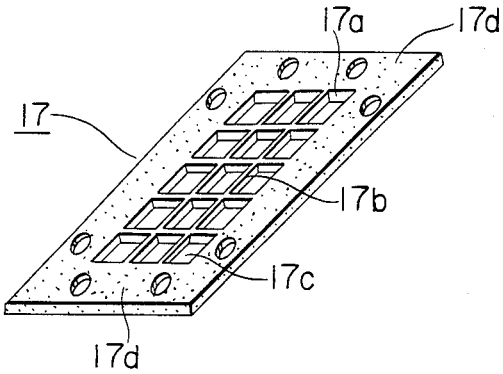
Figure 18:
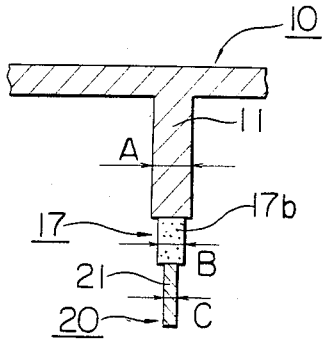

Referring to FIGS. 16 to 18, an automatic ice making machine or apparatus according to a fourth embodiment of the present invention will be explained in detail. In these figures, the same numerals as those used in FIG. 1 are used to designate the same or equivalent parts.

Referring to FIG. 16, the numeral 10 designates a freezing grid or chamber in the form of a pan or box and divided into a large number of freezing cells 12 by a plurality of partitioning plates. An evaporator 14 and a sensor 16 of a freezing or ice-forming thermostat 15 are provided on an outer surface 13 of the freezing chamber 10. To the lower side of the freezing chamber 10 is mounted a heat-insulating frame 17 having a profile generally conforming to the freezing chamber 10 having the freezing cells 12, partitioning plates and flanges 10*a*. Thus, as shown in FIG. 17, the heat insulating frame 17 is provided with square through-holes 17*c* presenting the inner sides 17*a*, heat-insulating partitioning plates 17*b* corresponding to the partitioning plates 11, and a flange 17*d* corresponding to the flange 10*a*. To the lower surface of the heat-insulating frame 17 is affixed a heating frame 20 which is shown in FIG. 3 and is the same as the ice-cutting frame according to the first embodiment described hereinabove. The heating frame 20 is provided with square through-holes 20*a* corresponding to the freezing cells 12, heating partitioning plates 21 corresponding to the partitioning plates 11, and a flange 18 corresponding to the flange 10*a*. The freezing grid 10 and the frames 17, 20 are connected together by a plurality of bolts 19 at the flanges 10*a*, 17*a* and 18. In the drawing, the insulating frame has a thickness D corresponding to the thickness of the heat insulating partitioning plates 17*b*.

Since the grid 10 and the frames 17, 20 are stacked with the cells 12 and the through-holes 17*c*, 20*a* in substantial alignment with each other, the partitioning plates 11, 17*b* and 21 can be bonded together with an adhesive without using the bolts 19.

To the outer side of the freezing chamber 10 is fitted a sensor 22*a* of the harvesting thermostat 22.

Beneath the freezing chamber 10, there are fixedly mounted a plurality of water spray pipe sections 24 each having a large number of water spray ports 23. The ice making water is sprayed in jets from these ports 23 upwards to about the center of the respective freezing cells. These pipe sections 24 are connected to a water distributor 25 to which the ice making water supplied by an ice-making water pump 27 in an ice-making water pump 27 in an ice-making water tank 26 is introduced via a conduit, not shown, as indicated by the broken arrows in FIG. 16. The ice-making water falling from the freezing chamber 10 is returned to the tank 26 by way of ice cube guide chute 28. The ice-making water is supplied into the tank 26 by a water charging pipe 30 provided with a water charging valve 29. The ice cubes 12*a* formed in the freezing chamber 10 are stored in an ice product reservoir 32.

With progress in the ice forming, ice is formed on the heat-insulating partitioning plates 17*b* of the heat-insulating frame 17. Just before completion of ice forming, a thin layer of ice starts to be formed on each heating partitioning plate 21 of the heating frame 20 despite the presence of the heat insulating frame 17.

In this state, as ice-making thermostat 15 senses the termination of ice making, the ice-making water pump 27 is stopped while the hot gas valve 34 is opened for introducing a hot gas into the evaporator by way of the hot gas pipe 41 so as to initiate a harvesting cycle. The water charging valve is also opened at this time for supplying ice-making water into the ice-making water tank 26. Since the heating frame 20 is formed of a material of relatively high thermal conductivity and thermally insulated from the freezing chamber 10 by the heat insulating frame 17, it is not cooled to as low a temperature as that of the freezing chamber 10, but is raised in temperature in a shorter time by being heated by the hot gas flowing in the pipe 41. As the harvesting cycle is initiated, the freezing chamber 10 is also gradually heated by the hot gas so that the ice cubes 12 start to melt. The thin layer of ice formed on the heating frame 20 is melted by the hot gas within a shorter time, while the ice blocks affixed to the sides 17*a* or the heat insulating partitioning plates 17*b* of the heat insulating frame 17 are also fused by the heating frame 20 which is heated by the hot gas pipe 41.

The freezing chamber is heated by the above described process until the contact surfaces of the ice cubes 12*a* with the walls of the freezing chambers 10 are completely melted so that the ice cubes start to drop by their own gravity.

When the descent of ice cubes 12*a* from the freezing chamber 10 is terminated, the temperature in the freezing chamber 10 rises rapidly so that the harvesting thermostat 22 is energized to close the hot gas valve and to actuate the ice-making water pump 27 for initiating the next ice-making cycle.

Although the hot gas is used in the present embodiment as heating means for the cutting frame, a similar effect may also be obtained by using electrical heating. The freezing chamber is not limited to the one shown and described above. Thus a freezing tray having a number of freezing cells formed of discrete cup-shaped elements opening towards the bottom, or a freezing grid having freezing cells formed as square through-holes with water jets sprayed from the top of the freezing cells, may also be used with the ice-making machine of the present invention.

Although the temperature sensor for sensing the termination of ice forming is attached in the above embodiment to the freezing chamber, such sensor may also be attached to the heating frame so that the temperature at which the thin ice layer starts to be formed is sensed as indexing the termination of ice formation.

In connection with the relative thickness of the partitioning plates 11, 17*b* and 21, it has been found that, by selecting a plate thickness so that the thickness of the partitioning plate 11, the heat insulating partitioning plate 17*b* and of the heating partitioning plate 21 are decreased in this order, the ice cubes 12 are allowed to descend very smoothly from the freezing cells.

With the above described construction and operation of the ice making machine of the present invention, the lower open edges of the respective freezing cells are separated from one another by a heat insulating frame for precluding the formation of the connecting portions between the adjacent ice cubes. This gives rise to the following advantages:

(i) The ice affixed to the heat insulating frame is melted promptly so that the harvesting cycle may be shortened with a corresponding increase in the daily ice output;

(ii) The hot gas is used as a heating source for the heating frame so that the flushing water is dispensed with, resulting in a saving of water. Also the apparatus is simple in structure and producible at low costs;

(iii) Even if the freezing grid has a large number of freezing cells, there is no necessity to fuse or cut the connecting portions of the ice cubes, so that the descent of ice cubes from the freezing cells is smooth and terminated in a shorter time, as a result of which the ice making capacity is improved, and a large sized freezing chamber having a lot of freezing cells can be obtained.

Figure 19:
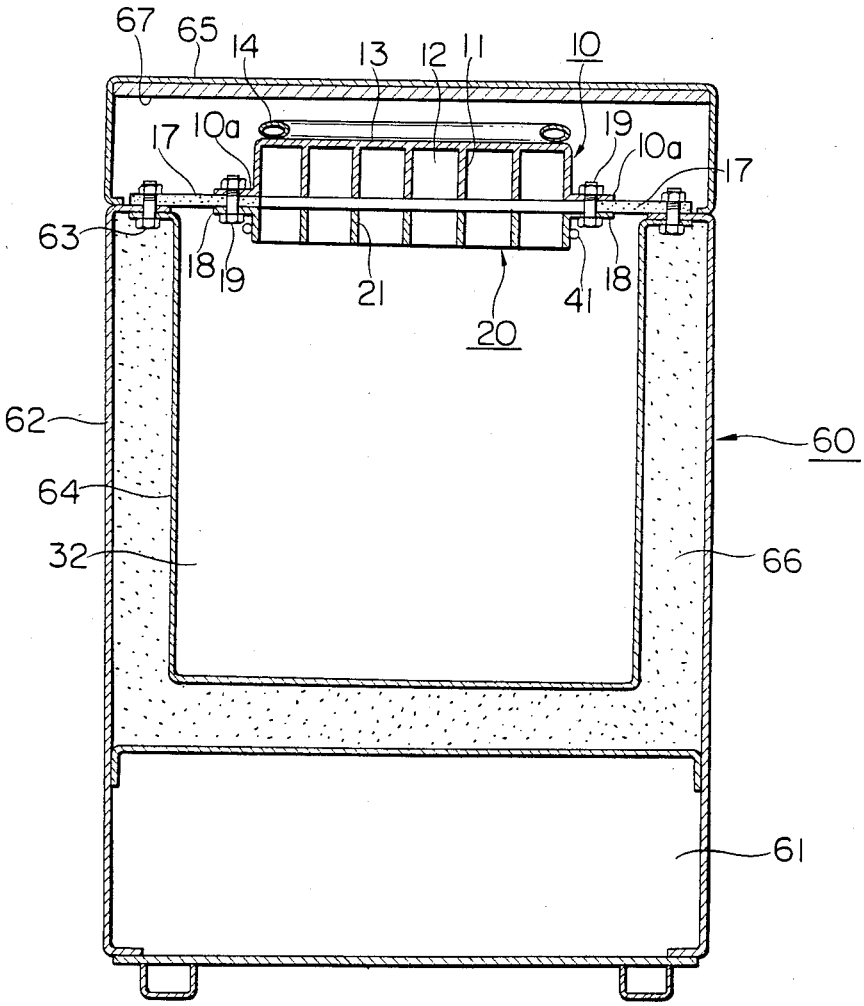
FIG. 19 is a sectional view showing a fifth embodiment of the present invention.

Referring to FIG. 19, a fifth embodiment of the present invention is explained. The same numerals as used in FIG. 1 are used to designate the same or equivalent parts. FIG. 19 shows the overall construction of the present invention which is comprised of a box-shaped body member or frame 60 in which are enclosed a refrigerating apparatus 61, an ice reservoir section 32, an ice-cutting frame 20 and an ice-making or freezing grid or chamber 10 formed of a relatively high heat conductive material. A number of partitioning plates are arranged in a grid pattern within the freezing chamber 10 which is thereby divided into a large number of freezing cells 12. An evaporator 14 is affixed to the outer surface 13 of the freezing chamber 10. At some preset distance below the freezing chamber 10 is positioned the ice-cutting frame 20 which is defined by ice-cutting partitioning plates 21 in opposition to the partitioning plates 11 of the freezing chamber and the perimeter of which is surrounded by a hot gas pipe 41 or an electric heater, not shown.

A plate-like insulating member 17 has its inner peripheral portion sandwitched between the peripheral mounting flange 10*a* of the freezing chamber 10 and the peripheral flange 18 of the ice-cutting frame 20. An extension of the insulating member 17 is securely mounted by bolts 63 to the uppermost portion of the side palte 62. Since the heat insulating member 17 is provided around the freezing grid 10 and the ice-cutting frame 20, the heat exchanged between the freezing chamber 10 and the ice-cutting frame 20 on the one hand and the evaporator 14 and the hot gas pipe 41 on the other is not expelled to the atmosphere through the main frame or body member 60. The insulating member 17 is of a sufficient mechanical strength to support the freezing grid 10, ice-cutting frame 29 and the evaporator 14. The bolts 63 are also passed through the upper part of an inner casing 64 forming an ice storage bin 32 for securing the inner casing 64 to the side plate 62.

Heat insulators 66, 67 are provided around the inner casing 64 and below a ceiling plate 65 for preventing heat from being discharged from the inside of the body member or main frame 60 into the atmosphere.

With the above described fifth embodiment of the present invention, the freezing grid or chamber is supported by the extension of the insulating member without requiring any special supporting components so that the overall device is simplified in structure and thus producible at lower costs.

What we claim is:

1. An automatic ice making machine, comprising:

a freezing chamber having chamber partitioning plates separating said freezing chamber into a large number of freezing cells opening downward for forming therein ice products of predetermined vertical length, said chamber partitioning plates having bottom surfaces;

a rigid ice-cutting framework having ice-cutting partitioning plates separating said ice-cutting framework into open framework cells, said ice-cutting framework being spaced at a preset distance below said freezing chamber partitioning plates less than said predetermined vertical length and being fixed to said freezing chamber with said ice-cutting partitioning plates and framework cells respectively vertically aligned with said bottom surfaces of respective ones of said chamber partitioning plates and with respective ones of said freezing cells;

means for directing ice making water upward from below said ice-cutting frame into repsective ones of said freezing cells through the framework cells aligned therewith;

means for freezing the ice making water in and below said freezing cells during an ice production cycle so as to produce ice products in said freezing cells; and means for heating said ice-cutting partitioning plates during a harvesting cycle so as to melt at least part of the ice produced below said freezing cells.

2. An automatic ice making machine as in claim 1, wherein said ice cutting frame is made of an electrically conductive material and said heating means comprises means for producing an electric current in said ice-cutting partitioning plates sufficient to heat said ice-cutting partitioning plates.

3. An automatic ice making machine as in claim 2, wherein said material is an electro-conductive resin.

4. An automatic ice making machine as in claim 1, wherein said chamber partitioning plates and said ice-cutting partitioning plates have open vertical gaps therebetween, said freezing means includes means for producing ice on said bottom surfaces in said vertical gaps connecting the ice products produced in said freezing cells, said heating means comprising means for melting the ice produced on said bottom surfaces so as to disconnect the ice products from each other.

5. An automatic ice machine as in claim 4, wherein said freezing means comprises an evaporator connected to said freezing chamber, said chamber partitioning plates being thicker than said ice-cutting partitioning plates so as to have side surfaces inwardly offset with respect to the freezing cells from the side surfaces of said ice-cutting partitioning plates, so that said framework cells have greater horizontal cross-sectional area than the respective freezing cells directly thereabove.

6. An automatic ice making machine as in claim 1, wherein said heating means comprises a hot gas pipe connected to said ice-cutting frame and means for producing a flow of hot gas in said hot gas pipe so as to heat said ice-cuqting frame.

7. An automatic ice making machine as in claim 1, further comprising an insulating element connecting said freezing chamber and said ice-cutting framework so as to form a rigid composite body formed of said freezing chamber, said insulting element and said ice-cutting framework.

8. An automatic ice making machine as in claim 7, further comprising an evaporator mounted on said freezing chamber, and a main frame, said insulating element having an extended portion extending from said freezing chamber and said ice-cutting framework and fixed to said main frame so that said freezing chamber, said ice-cutting framework, and said evaporator are supported by and secured to said main frame through said extended portion.

9. An automatic ice making machine as in claim 1, further comprising an insulating element connecting said freezing chamber and said ice-cutting framework so as to form a rigid composite body formed of said freezing chamber, said insulating element and said ice-cutting framework, said insulating element having heat-insulating partitioning plates similarly profiled to that of said ice-cutting partitioning plates and said chamber partitioning plates so that respective ones of said heat-insulating partitioning plates abut said bottom surfaces of respective ones of said chamber partitioning plates and respectively aligned ones of said ice-cutting partitioning plates, said heating means comprising means for melting portions of the ice produced by said freezing means below said freezing cells formed on said heat-insulating partitioning plates.

10. An automatic ice making machine as in claim 9, wherein said freezing means comprises an evaporator connected to said freezing chamber, said ice-cutting framework being formed of a heat conducting material.

11. An automatic ice making machine as in claim 9, wherein the horizontal thicknesses of said chamber partitioning plates are greater than the horizontal thicknesses of said heat-insulating partitioning plates and the horizontal thicknesses of said heat-insulating partitioning plates are greater than the horizontal thicknesses of said ice-cutting partitioning plates, so as to facilitate decent of the ice products from said freezing cells.

12. An automatic ice making machine as in claim 1, further comprising means in said ice-cutting frame for detecting, and producing a first signal indicative of, the presence of ice on said ice-cutting partitioning plates during said ice production cycle, and for detecting, and producing a second signal indicative of, the absence of ice on said ice-cutting partitioning plates during said harvesting cycle, means, responsive to said first signal, for terminating said ice production cycle and commensing said harvesting cycle, and means, responsive to said second signal, for terminating said harvesting cycle and commensing said ice production cycle.

13. An automatic ice making machine as in claim 1, wherein said freezing means comprises an evaporator connected to said freezing chamber, said chamber partitioning plates being thicker than said ice-cutting partitioning plates so as to have side surfaces inwardly offset with respect to the freezing cells from the side surfaces of said ice-cutting partitioning plates, so that said framework cells have greater horizontal cross-sectional area than the respective freezing cells directly thereabove.

14. An automatic ice making machine as in claim 1, wherein said freezing chamber has a chamber frame having an inner surface surrounding said chamber partitioning plates, said chamber frame supporting opposite ends of said chamber partitioning plates, said ice-cutting framework including an ice-cutting frame surrounding said chamber partitioning plates, said ice-cutting frame supporting opposite ends of said ice-cutting partitioning plates, said machine further comprising insulating means provided between said chamber frame and said ice-cutting frame, for heat insulating said ice-cutting framework from said freezing chamber, said insulating means having an inner surface offset outwardly with respect to the inner surface of said chamber frame.

15. An automatic ice making machine as in claim 2, further comprising means in said ice-cutting frame for detecting, and producing a first signal indicative of, the presence of ice on said ice-cutting partitioning plates during said ice production cycle, and for detecting, and producing a second signal indicative of, the absence of ice on said ice-cutting partitioning plates during said harvesting cycle, means, responsive to said first signal, for terminating said ice production cycle and commensing said harvesting cycle, and means, responsive to said second signal, for terminating said harvesting cycle and commensing said ice production cycle.

* * * * *